US006095201A

United States Patent [19]

Zenoni et al.

[11] Patent Number: 6,095,201

[45] Date of Patent: Aug. 1, 2000

[54] ELECTROMAGNETIC YARN STOPPING DEVICE FOR PREMEASURING WEFT FEEDERS OF AIR-JET LOOMS

[75] Inventors: Pietro Zenoni; Giovanni Pedrini, both of Leffe; Rosario Castelli, Gandino, all of Italy

[73] Assignee: L.G.L. Electronics S.p.A., Gandino, Italy

[21] Appl. No.: 09/347,304

[22] Filed: Jul. 6, 1999

[30] Foreign Application Priority Data

Jul. 17, 1998 [IT] Italy ..... T098A0622

[51] Int. Cl.[7] ..... D03D 47/36

[52] U.S. Cl. ..... 139/452; 242/365.4; 335/257

[58] Field of Search ..... 335/256, 257; 139/452; 242/365.4

[56] References Cited

U.S. PATENT DOCUMENTS

| | | | |
|---|---|---|---|
| 3,400,351 | 9/1968 | Flentge | 335/257 |
| 4,486,728 | 12/1984 | Hastings et al. | 335/256 |
| 4,632,155 | 12/1986 | Maina | 139/452 |
| 5,016,681 | 5/1991 | Ghiardo | 139/452 |
| 5,918,646 | 7/1999 | Covelli | 139/452 |

FOREIGN PATENT DOCUMENTS

| | | |
|---|---|---|
| 0363938 | 4/1990 | European Pat. Off. . |
| 0581745 | 2/1994 | European Pat. Off. . |
| 96 19605 | 6/1996 | WIPO . |

*Primary Examiner*—Andy Falik
*Attorney, Agent, or Firm*—Guido Modiano; Albert Josif; Daniel O'Byrne

[57] ABSTRACT

A device for stopping the yarn for premeasuring weft feeders of air-jet looms, of the electromagnetic type, comprising a stop finger which can move radially with respect to a drum of a weft feeder and is adapted to laterally engage a yarn in order to block its unwinding from the drum. The device further comprises at least one permanent magnet which is constituted by at least one cylindrical body in which the polar axis is orientated radially. The cylindrical body is associated with a stem which is provided with the stop finger and can move in a linear fashion inside a cylindrical surface on which at least one coil is wound, an excitation current flowing through the coil. The axis of the cylindrical surface, which coincides with the axis of the movable stem, is perpendicular to the polar axis of the cylindrical body of the permanent magnet.

13 Claims, 3 Drawing Sheets

ELECTROMAGNETIC YARN STOPPING DEVICE FOR PREMEASURING WEFT FEEDERS OF AIR-JET LOOMS

BACKGROUND OF THE INVENTION

The present invention relates to yarn stopping devices for premeasuring weft feeders of air-jet looms.

Conventional weft feeders are devices designed to accumulate a reserve of yarn in the form of turns wound on a fixed drum and to feed the loom by unwinding the accumulated turns in an amount equal to the length L of the yarn required by the loom at each beat; such length is equal to the transverse dimension or width of the fabric being formed.

In the specific case of air-jet looms, the weft feeder is also designed to premeasure the length L; this function is performed by counting, by means of a photoelectric sensor associated with a microprocessor, the unwound turns of yarn, with $$L=n\pi D$$

where n is the number of unwound turns and D is the diameter of the drum of the weft feeder.

The unwinding of the yarn is controlled by a stop device, typically of the electromagnetic type, which by means of a stop finger which can move radially with respect to the drum engages the yarn, blocking its unwinding, when the n-th turn is reached.

More specifically, when the last-but-one turn n-1 is counted, the photoelectric sensor and the cooperating microprocessor activate the power supply of the stop device, whose intervention is completed after the unwinding of the subsequent last turn (n).

As can be appreciated, the intervention time t available to the stop device is very short. It is typically between 10 and 20 ms (milliseconds) in view of the speed of modern air-jet looms, which are capable of inserting approximately 1,500 meters of weft per minute.

These demanding operating conditions have posed, and still pose, considerable problems in the provision of electromagnetic stop devices, which must have extremely high intervention speeds and must have moving parts which have a very small inertia but, at the same time, a high magnetomotive force and an acceptable life, for example equal to four or five years of operation, and therefore the ability to perform approximately $10^9$ operating cycles without being damaged.

SUMMARY OF THE INVENTION

The aim of the present invention is to provide an improved electromagnetic stopping device which adequately meets these requirements, is structurally very sturdy and is at the same time capable of very fast interventions, typically on the order of a few milliseconds.

A further object of the present invention is to provide an improved stopping device which allows, if required, controlled movements of the stop finger so as to eliminate any rebounds of the stop finger when it reaches the ends of its stroke.

A further important object of the present invention is to provide a stopping device wherein the controlled movements of the stop finger sequentially allow to first stop the unwinding of the yarn when the premeasured length of weft has been reached and then to block the yarn to prevent the residual turns that are present on the drum of the weft feeder from loosening and overlapping or entangling, with consequent operating problems when the stop finger is released.

This aim, these important objects and others which will become apparent hereinafter are achieved with a yarn stopping device according to the present invention, which has the specific characteristics stated in the appended claims.

Substantially, the invention is based on the concept of improving the electromagnetic stopping device by providing it with at least one permanent magnet constituted by a cylindrical body whose N-S polar axis is orientated radially and by associating the magnet with a movable stem which supports the stop finger and moves in a linear fashion inside a cylindrical surface which is separated from the magnet by a gap and is in turn provided with at least one coil through which an excitation current flows, the axis of said coil coinciding with the axis of the movable stem and being perpendicular to said N-S polar axis.

Typically, the cylindrical permanent magnet is made of one of the following magnetic materials: neodymium or samarium-cobalt, and is fitted on a support of nonmagnetic material which is rigidly coupled to said movable stem, which moves within guiding bushes provided on said cylindrical surface. Preferably, the guiding bushes are provided with disk-like abutment surfaces which have elastomeric rings suitable to cushion the stroke limit impact of said magnetic support against said abutment surfaces.

According to a further embodiment of the present invention, a linear motion sensor is associated with the movable stem of the stopping device and is capable of providing a feedback signal which allows to control the speed and/or characteristics of the motion of said stem. For example, the feedback signal can be used to vary the travel speed of the stem, reducing it proximate to the stroke limit points in order to avoid rebounds of the stop finger. Moreover, said feedback signal can be used to move the stop finger so as to stop and then lock the weft yarn.

BRIEF DESCRIPTION OF THE DRAWINGS

Further characteristics and advantages of the stopping device according to the present invention will become apparent from the following detailed description and with reference to the accompanying drawings, given by way of nonlimitative example, wherein:

FIGS. 4*a* and 4*b* are partial sectional views, similar to FIG. 4, of the device in two successive operating configurations;

DESCRIPTION OF THE PREFERRED EMBODIMENT

Figure 1:
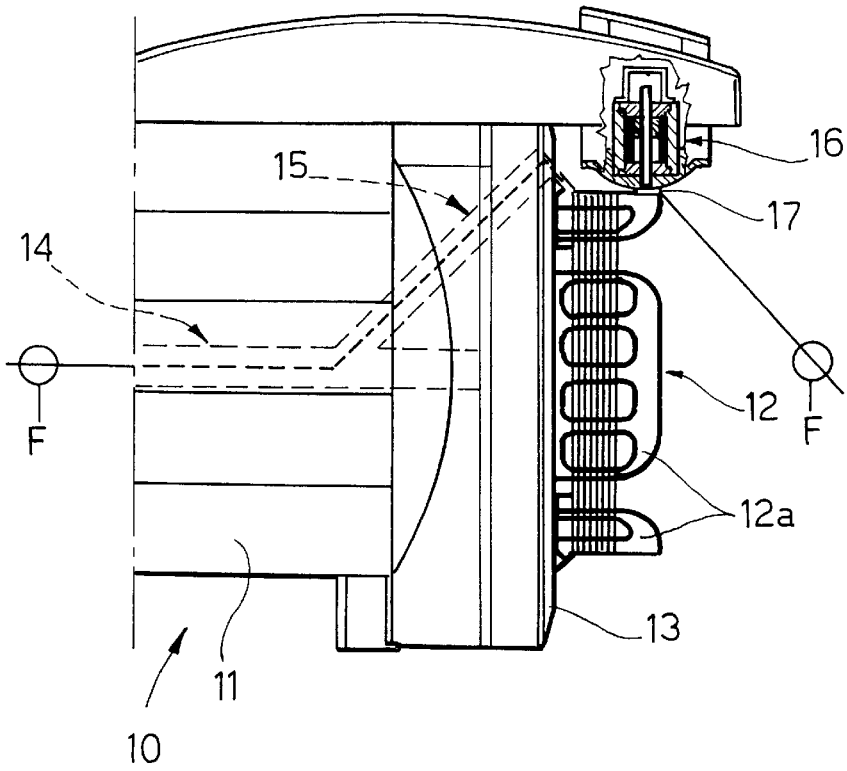
FIG. 1 is a partially sectional view of a premeasuring weft feeder for air-jet looms with a stopping device according to the present invention.

With reference to the above figures, the reference numeral 10 generally designates a premeasuring weft feeder for air-jet looms which comprises, in a manner known per se, a fixed body 11, a fixed drum 12 formed by side-by-side sectors 12*a*, and a rotating disk 13 which is arranged at the base of the drum and is actuated by a hollow driving shaft 14. A hollow rotating arm 15 is rigidly coupled to the disk 13 and is connected to the shaft 14. The yarn F runs through the cavity of the shaft 14 and of the arm 15 and is wound by the disk 13 onto the drum 12 in order to form a reserve of yarn to be fed to a loom (not shown).

At each beat of the loom, n turns of yarn, equal to the length L of the weft that the loom inserts with the beat, are unwound from the drum 12. The number of turns that unwind is counted by a photoelectric sensor (not shown), which cooperates with a microprocessor $\mu$P which, when the last-but-one turn (n-1) is reached, presets the excitation of the stopping device 16. The stopping device is provided with a stop finger 17 whose end, as a consequence of the excitation of the device 16, enters loosely a corresponding hole 18 of the drum 12 (see FIG. 2, for example) and laterally engages the yarn F, stopping its unwinding.

According to the present invention, the device 16, which is of the electromagnetic type, is provided with a movable stem 19 provided with the stop finger 17, with which at least one permanent magnet is associated; said permanent magnet is constituted by a cylindrical body 20 made of a material with extremely high magnetic hysteresis, typically neodymium or samarium-cobalt, in which the N-S polar axis is orientated radially and so that the N pole faces outward.

The cylindrical body 20 is fitted, preferably with a cylindrical bush of ferrous material (not shown) interposed, on a support 21 made of nonmagnetic material, advantageously plastics, which is stably rigidly coupled to the stem 19 and moves in a linear fashion inside a cylindrical surface 22 made of a material having high magnetic permeance, from which it is separated by a gap TR. The cylindrical surface 22 is provided, for assembly purposes, in two juxtaposed portions 22*a* and 22*b*, each of which delimits a corresponding stator pole and is provided with a guiding and retention bush 23*a* and 23*b* for the stem 19. The bushes 23*a* and 23*b* have disk-like abutment surfaces 24*a* and 24*b* provided with respective annular seats for corresponding elastomeric rings 25*a* and 25*b* of the O-ring type, which are suitable to cushion the stroke limit impact of said support 21 against the abutment surfaces 24*a* and 24*b*.

Figure 5:
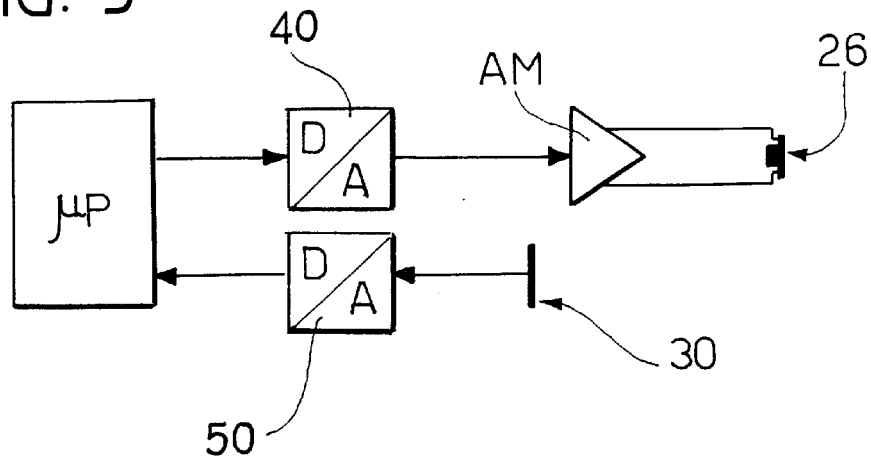
FIG. 5 is the electrical diagram of the power supply means of the stopping device.

An excitation coil 26 is wound on the cylindrical surface 22 and is supplied with an excitation current I generated by a power transducer AM which is driven by a microprocessor $\mu$P with a digital/analog converter 40 (FIG. 5).

Figure 2:
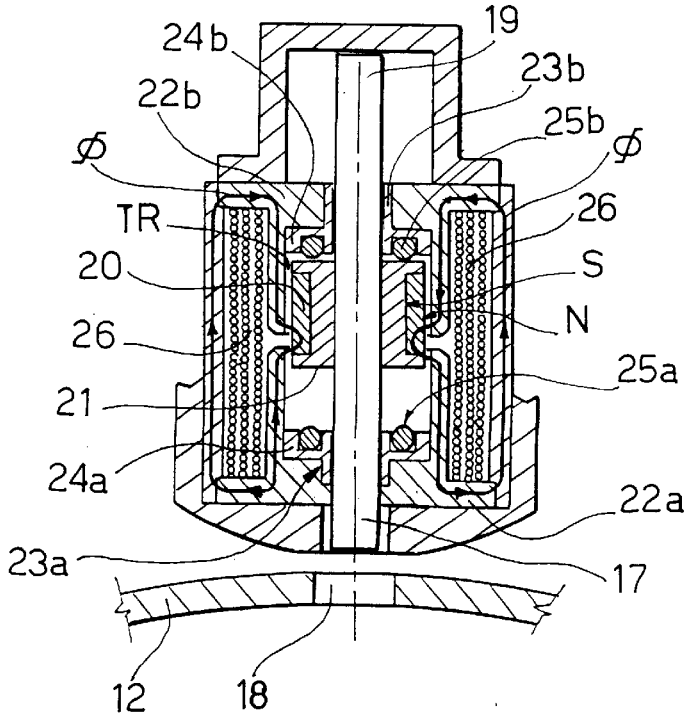
FIG. 2 is a highly enlarged axial longitudinal sectional view of the stopping device according to a first embodiment of the present invention.

With the described arrangement, the magnet 20 generates a magnetic field $\phi$ whose lines of force, shown in FIG. 2, concatenate with the field generated by the coil 26, generating an intense force F which is directed along the axis of the stem 19 and is expressed by the relation F=K.Br.Dm.n.I, where n is the number of turns of the coil 26, I is the excitation current that flows through said coil, K is a constant which depends on the overall geometry of the system and on the type of permanent magnet 20, Br is the residual induction of said magnet and Dm is its average diameter.

Figure 3:
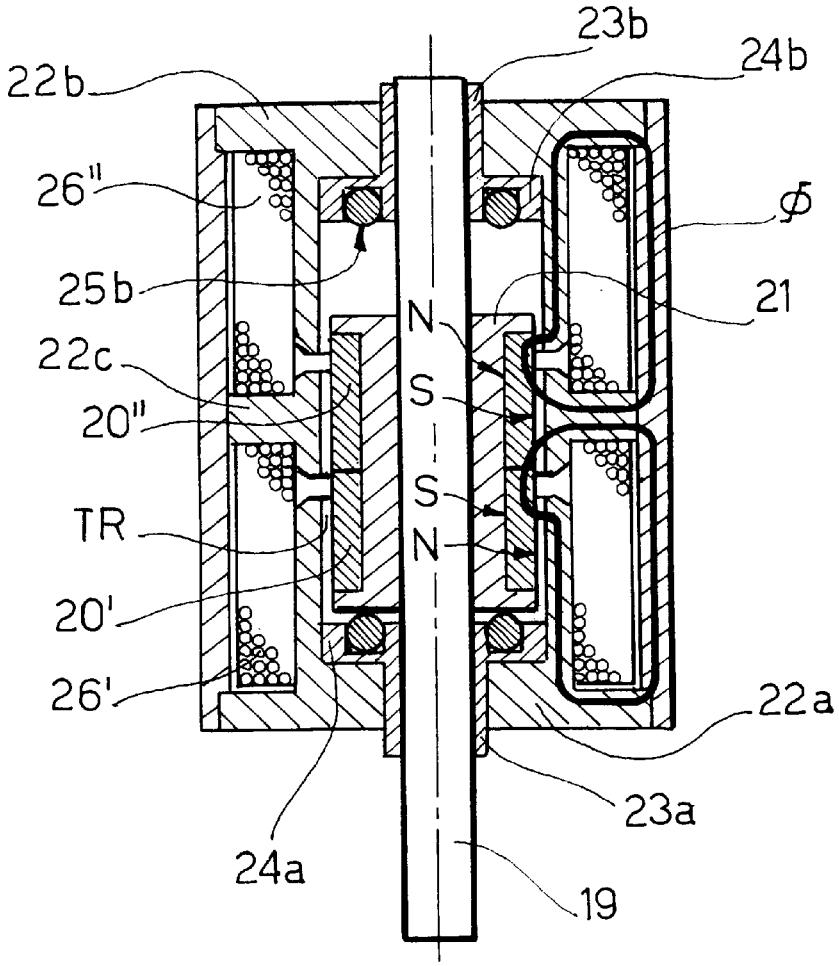
FIG. 3 is a sectional view, similar to FIG. 2, of a second embodiment of said stopping device.

The variation of FIG. 3, which is adapted to generate a significantly greater electromotive force for an equal power absorption, differs constructively owing to the presence of a third portion of cylindrical surface 22*c* which is interposed between the two juxtaposed surfaces 22*a* and 22*b* and forms a corresponding third stator pole.

According to this embodiment, the cylindrical body of the permanent magnet is formed by two cylindrical permanent-magnet portions 20'–20" which are superimposed and have opposite N-S radial polarities, as shown in the figure. Correspondingly, the excitation coil is formed by two windings 26'–26" which are separated by the third portion 22*c* of the cylindrical surface and are preferably arranged electrically in series. In this way, the electromotive force F is substantially doubled for an equal excitation current I.

Figure 4:
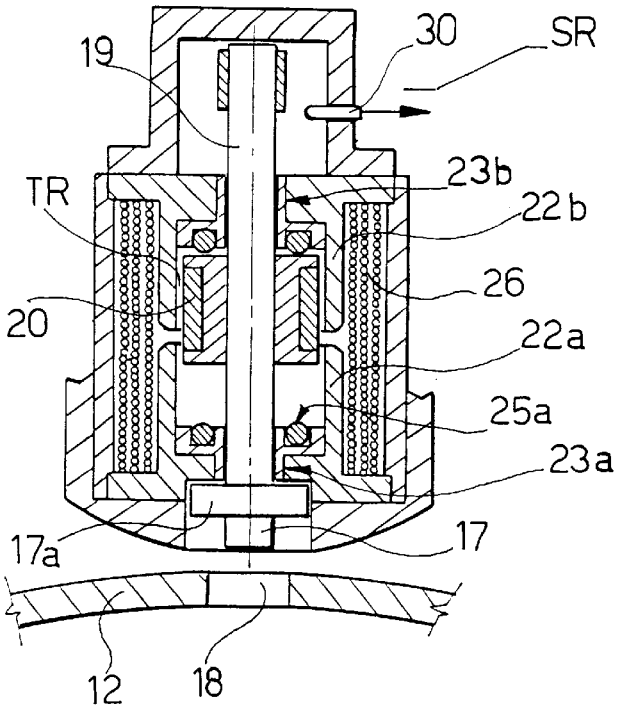
FIG. 4 is a sectional view, similar to FIG. 2, of third embodiment of the stopping device, the device being shown in the inactive condition.
Figure 4:
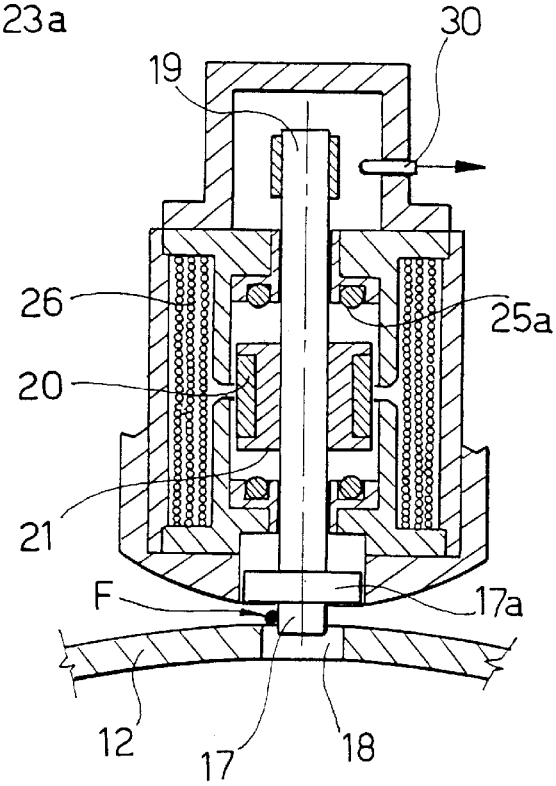
Figure 4:
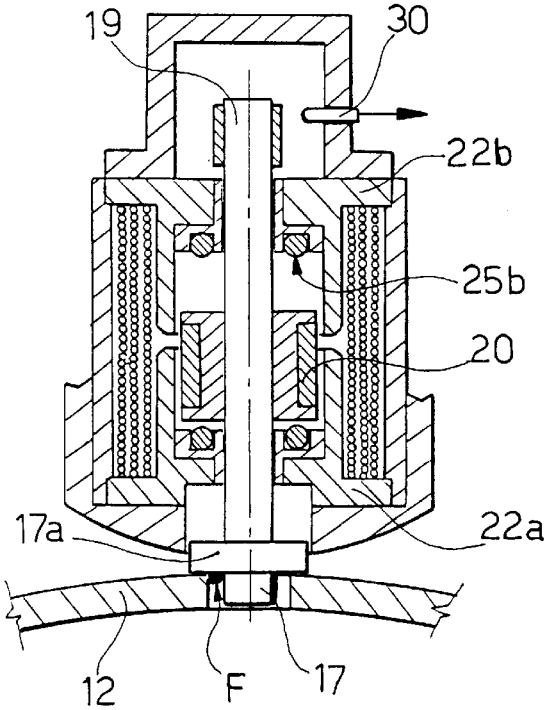

In the different embodiment of FIG. 4, a linear motion sensor, generally designated by the reference numeral 30, is associated with the stem 19 of the stopping device 16. The sensor 30 is capable of providing an analog feedback signal SR, for example in terms of voltage, which can be used to control the motion of the stem 19.

For example, the feedback signal SR, after analog-digital conversion performed by a corresponding converter 50, can be applied to the microprocessor $\mu$P and be employed to vary the excitation current I so that the travel speed of the stem 19 decreases proximate to the stroke limit points, so as to avoid rebounds of the stop finger 17. According to the present invention, it is also possible to use the feedback signal SR to move the stem 19 so as to produce sequentially:

a) a partial lowering of the stem 19, consequently stopping the yarn F against the lateral surface of the stop finger 17 (FIG. 4*a*); and b) a subsequent further lowering of the stem 19, with temporary blocking of the yarn F, for the specified purposes, by a flange 17*a* which is associated with the finger 17 and is suitable to clamp the yarn against the drum 13 (FIG. 4*b*).

Without altering the concept of the invention, the details of execution and the embodiments may of course be changed extensively with respect to what has been described and illustrated by way of non-limitative example without thereby abandoning the scope of the invention.

What is claimed is:

1. A device for stopping the yarn for premeasuring weft feeders of air-jet looms, of the electromagnetic type, comprising a stop finger which can move radially with respect to a drum of a weft feeder and is adapted to laterally engage a yarn in order to block its unwinding from said drum, further comprising at least one permanent magnet which is constituted by at least one cylindrical body in which the polar axis (N-S) is orientated radially, said cylindrical body being associated with a stem which is provided with the stop finger, the stem being movable in a linear fashion inside a cylindrical surface on which at least one coil is wound, an excitation current flowing through said coil; the axis of said cylindrical surface, which coincides with the axis of the movable stem, being perpendicular to the polar axis (N-S) of said cylindrical body of the permanent magnet.

2. The device according to claim 1, wherein said cylindrical body of the permanent magnet is separated from said cylindrical surface by a gap.

3. The device according to clain 1, wherein said cylindrical body of the permanent magnet is made of neodymium or samarium-cobalt.

4. The device according to claim 1, wherein said cylindrical permanent magnet body is fitted, either directly or with a bush of ferrous material interposed, on a support made of nonmagnetic material which is rigidly coupled to said movable stem.

5. The device according to claim 4, wherein said nonmagnetic support is made of polymeric material.

6. The device according to claim 5, wherein said cylindrical surface is made of a material having high magnetic permeance and comprising at least two juxtaposed portions which each define a corresponding stator pole.

7. The device according to claim 6, wherein said juxtaposed portions of the cylindrical surface are each provided with a respective guiding and retention bush for the movable stem.

8. The device according to claim 7, wherein said bushes are provided with disk-like abutment surfaces which are provided with respective annular seats for corresponding elastomeric rings which are suitable to cushion the stroke limit impact of said nonmagnetic support against said abutment surfaces.

9. The device according to claim 8, wherein said cylindrical surface comprises a third portion of cylindrical surface which is interposed between the juxtaposed portions and forms a corresponding third stator pole, and wherein the cylindrical permanent magnet body is formed by two superimposed cylindrical portions which have opposite radial polarities, and wherein said at least one coil is formed by two windings which are separated by said third cylindrical surface portion and are electrically series-connected.

10. The device according to claim 1, comprising a linear motion sensor which is associated with the movable stem provided with the stop finger, said sensor providing an analog feedback signal for controlling the motion of said stem.

11. The device according to claim 10, wherein said sensor is connected to a microprocessor which controls said excitation current that circulates in said at least one coil.

12. The device according to claim 11, wherein said microprocessor includes programming means for varying the current that circulates in the coil so that the travel speed of the stem decreases proximate to points of stroke limit of said stem.

13. The device according to claim 11, wherein said microprocessor includes programming means for varying the current that circulates in said coil so as to move the stem in such a way to produce sequentially:

a) a partial lowering of said stem, consequently stopping the yarn against a lateral surface of the stop finger; and b) a subsequent further lowering of said stem, with temporary blocking of the yarn against the drum of the weft feeder.

* * * * *